US011074926B1

(12) United States Patent
Baughman et al.

(10) Patent No.: US 11,074,926 B1
(45) Date of Patent: Jul. 27, 2021

(54) TRENDING AND CONTEXT FATIGUE COMPENSATION IN A VOICE SIGNAL

(71) Applicant: International Business Machines Corporation, Armonk, NY (US)

(72) Inventors: Aaron K. Baughman, Cary, NC (US); Shikhar Kwatra, Durham, NC (US); Gary William Reiss, Buford, GA (US); Gray Cannon, Miami, FL (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 19 days.

(21) Appl. No.: 16/736,005

(22) Filed: Jan. 7, 2020

(51) Int. Cl.

| | |
|---|---|
| ***G10L 21/003*** | (2013.01) |
| ***G10L 21/0364*** | (2013.01) |
| ***G10L 25/51*** | (2013.01) |
| ***G10L 13/047*** | (2013.01) |
| ***G10L 13/00*** | (2006.01) |

(52) U.S. Cl.
CPC ..... *G10L 21/0364* (2013.01); *G10L 13/00* (2013.01); *G10L 13/047* (2013.01); *G10L 21/003* (2013.01); *G10L 25/51* (2013.01)

(58) Field of Classification Search
None
See application file for complete search history.

(56) References Cited

U.S. PATENT DOCUMENTS 6,151,571 A * 11/2000 Pertrushin ..... G10L 17/26 704/209
2007/0250324 A1* 10/2007 Nakanura ..... G10L 21/04 704/503
2010/0070283 A1* 3/2010 Kato ..... G10L 25/87 704/278

(Continued)

FOREIGN PATENT DOCUMENTS

CN 102117614 B 1/2013
EP 1222448 A1 7/2002

(Continued)

OTHER PUBLICATIONS washington.edu, "Voice, What is a Voice Disorder?" 2015-2019, https://sphsc.washington.edu/voice.

(Continued)

*Primary Examiner* — Douglas Godbold
(74) *Attorney, Agent, or Firm* — Garg Law Firm, PLLC; Rakesh Garg; Michael O'Keefe

(57) ABSTRACT

A method for voice signal fatigue compensation, that includes sampling, using an audio signal capturing apparatus, a segment of a voice signal in a normal time series to form a normal series sample, generating, using a processor and a memory, from the normal series sample, a reversed series sample, and constructing, by executing using the processor and the memory a time-series mixing component, a first synthesized segment by mixing the normal series sample and the reversed series sample, the first synthesized segment including a compensation for an instance of micro (Continued)

fatigue in the segment of the voice signal. The method also includes forming a fatigue-compensated voice segment from the first synthesized segment, and outputting, as a fatigue-compensated voice segment, the first synthesized segment.

20 Claims, 9 Drawing Sheets

(56) References Cited

U.S. PATENT DOCUMENTS

| | | | | |
|---|---|---|---|---|
| 2011/0125493 | A1* | 5/2011 | Hirose | G10L 21/04 704/207 |
| 2012/0022880 | A1* | 1/2012 | Bessette | G10L 19/18 704/503 |
| 2012/0109632 | A1* | 5/2012 | Sugiura | G10L 15/20 704/3 |
| 2014/0108015 | A1* | 4/2014 | Ryu | G10L 13/02 704/261 |
| 2016/0071524 | A1* | 3/2016 | Tammi | G11B 27/005 386/343 |
| 2019/0124441 | A1* | 4/2019 | Dong | H04R 1/08 |

FOREIGN PATENT DOCUMENTS

| | | | |
|---|---|---|---|
| EP | 1423846 | B1 | 3/2006 |
| EP | 1222448 | B1 | 10/2006 |
| JP | 4195428 | B2 | 12/2008 |
| JP | 2010117528 | A | 5/2010 |
| JP | 5152588 | B2 | 12/2012 |

OTHER PUBLICATIONS

Prentice Hall,"Digital Signal Processing Applications Using the ADSP 2100 Family", Chapter 10, pp. 355-372, Englewood Cliffs, N.J., 1992, Using the ADSP-2100 Family vol. 1.

mathworks.com, Convolution of a Signal With Window Function, Dec. 1, 2014, https://www.mathworks.com/matlabcentral/answers/164933-convolution-of-a-signal-with-window-function.

terpconnect.umd.edu, Peak Finding and Measurement, May 17, 2008, https://terpconnect.umd.edu/~toh/spectrum/PeakFindingandMeasurement.htm.

O'Haver, "Matlab/Octave Peak Fitters", Sep. 18, 2019, https://terpconnect.umd.edu/~toh/spectrum/InteractivePeakFitter.htm.

O'Haver, "Curve fitting C: Non-linear Iterative Curve Fitting", Sep. 18, 2019, https://terpconnect.umd.edu/~toh/spectrum/CurveFittingC.html.

* cited by examiner

TRENDING AND CONTEXT FATIGUE COMPENSATION IN A VOICE SIGNAL

TECHNICAL FIELD

The present invention relates generally to a method, computer program product, and system in the field of audible signals. More particularly, the present invention relates to a method, computer program product, and system for voice signal fatigue compensation.

BACKGROUND

Voice compensation is the field of editing and filtering a voice signal to enhance desirable features and minimize undesirable elements in an effort to improve hearing quality for an audience. In voice communications over a long period (e.g., providing play-by-play coverage of a game), the broadcaster's voice can suffer from several types of voice fatigue. One type of voice fatigue is "trending fatigue", defined as the broadcaster's voice volume and power diminishing over time. Trending fatigue can also be represented as "dampening signal strength" of the voice signal. Another fatigue type in a voice signal is "context fatigue" (micro fatigue), where small episodes of fatigue occur and then are overcome by a renewed effort by the broadcaster in an effort to compensate for the fatigue. An example of micro fatigue is a sudden moment of excitement during a big play where the broadcaster's voice rises in power and volume, and then returns to a weaker volume level.

In voice signals, an additional element is the presence (or absence) of regional dialects and accents. Terms and phrases that are understood in one geographical region or population may be understood by one subset of listeners while not understood by another subset of listeners, even when the voice signal uses the same underlying language. Local vocabulary, terms of art, and references to localized events, locations, and characters can also introduce potential errors in populations listening to a voice signal. The presence of dialects in a broadcaster's voice, or absence of a local or preferred dialect, can be difficult or impossible for localized users to understand or follow along.

Voice signals can be quantified by several measurements, including but not limited to amplitude, peak amplitude, frequency, power distribution over time, and energy. In some cases, it is advantageous to measure voice signals over the time domain to capture peak amplitude, power, volume, and the like over time. In other cases, a voice signal can be measured using the frequency domain, which defines the voice signal's constituent components, or sinusoidal frequencies, that are present in a voice signal. One method of converting a voice signal measurement from the time domain to the frequency domain and back is to apply a Fast Fourier Transform (FFT), a mathematical operation applied to a quantized voice signal.

A technique employed in analyzing and quantizing a voice signal is termed reversed signal sampling. This process involves storing a limited time period segment of a voice signal and then saving the segment with the time period reversed so that the temporal end of the segment marks the beginning of the sample. This process aids in understanding the correct emphasis on target words by enabling cross-validation of the voice signals between regular and reversed signals. In addition, windowing and peak detection algorithms can change based on the time order of the voice signal (normal or reversed). In some cases, reversed signal sampling also aids in understanding if special characters or sounds were intended to be used in the voice signal.

Another technique used in voice sound processing is the Mel-frequency cepstrum (MFC), a representation of the power spectrum of a voice signal across a time period. The Mel scale is a non-linear scale of pitches as heard by the human ear and better approximates a person's hearing detection and recognition of sounds better than using a linear scale. The MFC is derived by applying a linear cosine transform of the log power spectrum to a nonlinear Mel scale of frequency. Mel-frequency cepstral coefficients (MFCCs) are coefficients that make up the MFC and are derived from a cepstral representation (from the result after taking the inverse Fourier transform of the log of the voice signal spectrum) of the segment of voice signal being analyzed. The MFCCs are the amplitudes of the resulting spectrum.

In the MFC, frequency bands are equally spaced on the Mel scale (which is similar to the human audible range). Meanwhile, the cepstrum has frequency bands that are linearly-spaced. The differences between the two allows for better representation of audible sound and signal analysis.

Another analysis tool is the maximum correntropy criterion (MCC) algorithm that is used in signals processing and voice pattern recognition. The MCC algorithm is particularly useful for nonlinear and non-Gaussian signal processing, especially when the voice signal contains large outliers or is disturbed by impulsive noises.

The Acoustic Change Complex (ACC) is another technique used for signals processing. ACC is a nonlinear frequency compression algorithm and is a signal processing technique used to increase the audibility of high-frequency speech sounds for hearing aid users with sloping high-frequency hearing loss.

Several additional techniques are also used in signals processing. A convolutional neural network (CNN) is a mathematical algorithm that employs an acoustic model and uses convolution, a type of mathematical operation instead of ordinary matrix multiplication. CNN's are used in normal language processing and CNN models provide detailed results in semantic sampling, classification, sentence modeling, and prediction. A generative adversarial network (GAN) is a machine learning process where 2 neural networks compete with one another on a task to generate a new data set related to, but different than an input data set. A Gaussian mixture model (GMM) is a probabilistic model that assumes all the data points are generated from a mixture of a finite number of Gaussian distributions with unknown parameters.

SUMMARY

The illustrative embodiments provide a method for voice signal fatigue compensation, that includes sampling, using an audio signal capturing apparatus, a segment of a voice signal in a normal time series to form a normal series sample, generating, using a processor and a memory, from the normal series sample, a reversed series sample, and constructing, by executing using the processor and the memory a time-series mixing component, a first synthesized segment by mixing the normal series sample and the reversed series sample, the first synthesized segment including a compensation for an instance of micro fatigue in the segment of the voice signal. The method also includes forming a fatigue-compensated voice segment from the first synthesized segment, and outputting, as a fatigue-compensated voice segment, the first synthesized segment.

An embodiment includes a computer program product that includes for voice signal fatigue compensation, the computer program product made of one or more computer readable storage media and program instructions collectively stored on the one or more computer readable storage media, the program instructions include program instructions to sample, using an audio signal capturing apparatus, a segment of a voice signal in a normal time series to form a normal series sample, program instructions to generate, using a processor and a memory, from the normal series sample, a reversed series sample, and program instructions to construct, by executing using the processor and the memory a time-series mixing component, a first synthesized segment by mixing the normal series sample and the reversed series sample, the first synthesized segment including a compensation for an instance of micro fatigue in the segment of the voice signal. The program instructions also include program instructions to form a fatigue-compensated voice segment from the first synthesized segment, and program instructions to output, as a fatigue-compensated voice segment, the first synthesized segment.

An embodiment includes a computer system that includes a processor, a computer-readable memory, a computer-readable storage device, and program instructions stored on the storage device for execution by the processor via the memory, the stored program instructions includes program instructions to sample, using an audio signal capturing apparatus, a segment of a voice signal in a normal time series to form a normal series sample, program instructions to generate, using a processor and a memory, from the normal series sample, a reversed series sample, and program instructions to construct, by executing using the processor and the memory a time-series mixing component, a first synthesized segment by mixing the normal series sample and the reversed series sample, the first synthesized segment including a compensation for an instance of micro fatigue in the segment of the voice signal. The program instructions also include program instructions to form a fatigue-compensated voice segment from the first synthesized segment, and program instructions to output, as a fatigue-compensated voice segment, the first synthesized segment.

BRIEF DESCRIPTION OF THE DRAWINGS

Certain novel features believed characteristic of the invention are set forth in the appended claims. The invention itself, however, as well as a preferred mode of use, further objectives and advantages thereof, will best be understood by reference to the following detailed description of the illustrative embodiments when read in conjunction with the accompanying drawings, wherein:

DETAILED DESCRIPTION

Figure 1:
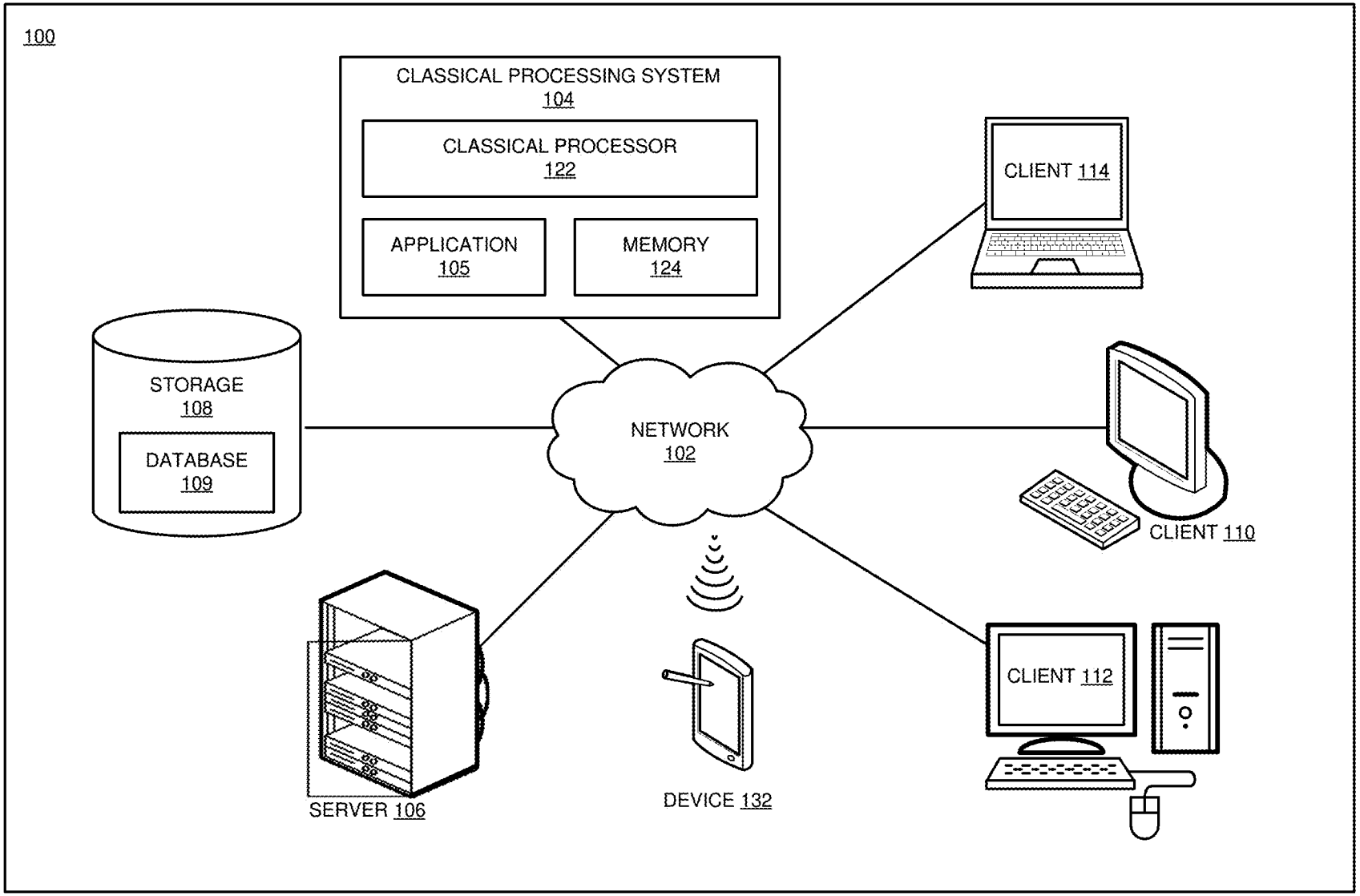
FIG. 1 depicts a block diagram of a network of data processing systems in which illustrative embodiments may be implemented.

The illustrative embodiments recognize that there is a need for compensating a voice signal for trending fatigue and micro fatigue. Furthermore, there is a need to compensate a voice signal for the use of dialects and accents to allow the voice signal to be heard and understood by a larger population. The voice signal is sampled both in normal time and in reversed time, and is subject to several signals analysis processes including MCC, ACC, and delta algorithms to derive macro- and micro-level voice values. Macro-level voice values leads to detecting trending fatigue while micro-level voice values aids in detecting micro fatigue. From this, different peaks of the voice signal waveforms are aligned to adjust for trending fatigue and micro fatigue. The micro fatigue level of a broadcaster's voice is compensated for by micro fatigue detection and correction. The bidirectional (normal and reversed sampling) voice signal analysis is also subject to a CNN spectrogram analysis, which works to detect and quantify levels of fatigue based on reversed speech analysis.

Using the methods and processes disclosed herein, the present embodiments also provide for enhanced real-time and near real-time excitement optimization measurements for broadcasters. The processes use multimedia and statistical predictors for real-time analysis. The processes also work to identify which indicators should be minimized to reduce or eliminate accidental bias through trending fatigue, regional dialects, and decreased voice signal power and volume. In some embodiments, the accidental bias is a variation in a set of peaks in the voice signal over a period. The processes also enable a detection mechanism for classifying emotion within the voice signal regardless whether the broadcaster uses a dialect or not. In some embodiments, emotions are detected or classified when a voice signal volume or power level exceeds a threshold value.

The process of peak detection defines windows (segments) of speech to assign a value to (stratify). The stratified voice signal is based on peak detection in both the reversed and normal time signal segments that are matched (mapped) together. The pairwise mapping permits the lookup of MCC, ACC, and DELTA components of both signals. The use of GAN's allows the generation a voice signal for the segment by setting a target to be the first half of the normal speech and the second half of the reversed speech. Other portions are possible and are not limited by this example. Applying the GAN process learns where and how to amplify the original voice signal segment. Each of the speech-simplified voice signal segments are then appended together to form a continuous voice signal.

Simultaneously, the trended fatigue level of the broadcaster is compensated for by fitting one or more meromorphic functions to the peaks of both the normal and the reversed segments of the voice signal. The two resultant meromorphic functions are then mixed together for an overall peak definition. The poles (peaks) from the meromorphic functions are used as targets for a CNN to learn how to modify a waveform given the peaks. The frequency and peaks of the signal are adjusted by the CNN. Finally, the micro and macro signals are used to adjust the original voice signal segment into a form that is compensated for both trending fatigue and micro fatigue.

In one example, a sports game (e.g., tennis) is characterized by several hours of silence and occasional bursts of excited voice signals from the broadcaster. Classifying the many hours of audio to identify highlights of the game is therefore complicated and lengthy. This disclosure presents methods for augmenting human speech by sound classification, enables the compensation of trending fatigue and micro fatigue, and minimizes the effects of local dialects by the use of machine learning. To begin, an algorithm capable of detecting and isolating potential points of interest in the voice signal is used to extract specific sounds such as excited calls, yells, and the like. These sounds are identified and labeled. Next, the voice signal is segmented into periods of equal length and sent to an acoustic model, such as a CNN or GAN. According to some embodiments, the segment period is 1 second long, while in another embodiment, the segment length is 200 ms. Other embodiments are possible and are not limited by these examples.

The CNN is used for peak detection, where higher-amplitude sounds are identified. Peak detection is performed by transforming the segmented sound wave into a 2-dimensional function in the time domain with the range tracing the amplitude of the sound wave. Next, another algorithm samples the sound for local maxima points which allows the export of a specific peak and referencing the midpoint of the peak. As an example, peak amplitude is detected with the sound wave. With a desired segment period of 1 second, a segment is defined with the peak at the midpoint of a segment period, with the segment extending 500 ms before and after the peak to form a segment 1 second long.

A peak can also detected by searching for the local maxima in the sound wave where the slope flips from positive to negative. Peak detection can also be accomplished by a wide variety of open-source software algorithms. Some algorithms also permit the use of a variable width in the algorithm to adjust for the total number of peaks detected. Also, a meromorphic function of the voice signal segment identifies the peaks (poles) which are asymptotes of a function. The algorithm will fit a function to the peaks such that the peaks become asymptotes The illustrative embodiments are described using specific code, designs, architectures, protocols, layouts, schematics, and tools only as examples and are not limiting to the illustrative embodiments. Furthermore, the illustrative embodiments are described in some instances using particular software, tools, and data processing environments only as an example for the clarity of the description. The illustrative embodiments may be used in conjunction with other comparable or similarly purposed structures, systems, applications, or architectures. For example, other comparable mobile devices, structures, systems, applications, or architectures therefor, may be used in conjunction with such embodiment of the invention within the scope of the invention. An illustrative embodiment may be implemented in hardware, software, or a combination thereof.

The examples in this disclosure are used only for the clarity of the description and are not limiting to the illustrative embodiments. Additional data, operations, actions, tasks, activities, and manipulations will be conceivable from this disclosure and the same are contemplated within the scope of the illustrative embodiments.

Any advantages listed herein are only examples and are not intended to be limiting to the illustrative embodiments. Additional or different advantages may be realized by specific illustrative embodiments. Furthermore, a particular illustrative embodiment may have some, all, or none of the advantages listed above.

FIG. 1 depicts a block diagram of a network of data processing systems in which illustrative embodiments may be implemented. Data processing environment 100 is a network of computers in which the illustrative embodiments may be implemented. Data processing environment 100 includes network 102. Network 102 is the medium used to provide communications links between various devices and computers connected together within data processing environment 100. Network 102 may include connections, such as wire, wireless communication links, or fiber optic cables.

Clients or servers are only example roles of certain data processing systems connected to network 102 and are not intended to exclude other configurations or roles for these data processing systems. Server 104 and server 106 couple to network 102 along with storage unit 108. Software applications may execute on any computer in data processing environment 100. Clients 110, 112, and 114 are also coupled to network 102. A data processing system, such as server 104 or 106, or client 110, 112, or 114 may contain data and may have software applications or software tools executing thereon.

Only as an example, and without implying any limitation to such architecture, FIG. 1 depicts certain components that are usable in an example implementation of an embodiment. For example, servers 104 and 106, and clients 110, 112, 114, are depicted as servers and clients only as example and not to imply a limitation to a client-server architecture. As another example, an embodiment can be distributed across several data processing systems and a data network as shown, whereas another embodiment can be implemented on a single data processing system within the scope of the illustrative embodiments. Data processing systems 104, 106, 110, 112, and 114 also represent example nodes in a cluster, partitions, and other configurations suitable for implementing an embodiment.

Device 132 is an example of a device described herein. For example, device 132 can take the form of a smartphone, a tablet computer, a laptop computer, client 110 in a stationary or a portable form, a wearable computing device, or any other suitable device. Any software application described as executing in another data processing system in FIG. 1 can be configured to execute in device 132 in a similar manner. Any data or information stored or produced in another data processing system in FIG. 1 can be configured to be stored or produced in device 132 in a similar manner.

Servers 104 and 106, storage unit 108, and clients 110, 112, and 114, and device 132 may couple to network 102 using wired connections, wireless communication protocols, or other suitable data connectivity. Clients 110, 112, and 114 may be, for example, personal computers or network computers. Application 105 implements an embodiment described herein.

In the depicted example, server 104 may provide data, such as boot files, operating system images, and applications to clients 110, 112, and 114. Clients 110, 112, and 114 may be clients to server 104 in this example. Clients 110, 112, 114, or some combination thereof, may include their own data, boot files, operating system images, and applications. Data processing environment 100 may include additional servers, clients, and other devices that are not shown.

In the depicted example, data processing environment 100 may be the Internet. Network 102 may represent a collection of networks and gateways that use the Transmission Control Protocol/Internet Protocol (TCP/IP) and other protocols to communicate with one another. At the heart of the Internet is a backbone of data communication links between major nodes or host computers, including thousands of commercial, governmental, educational, and other computer systems that route data and messages. Of course, data processing environment 100 also may be implemented as a number of different types of networks, such as for example, an intranet, a local area network (LAN), or a wide area network (WAN). FIG. 1 is intended as an example, and not as an architectural limitation for the different illustrative embodiments.

Among other uses, data processing environment 100 may be used for implementing a client-server environment in which the illustrative embodiments may be implemented. A client-server environment enables software applications and data to be distributed across a network such that an application functions by using the interactivity between a client data processing system and a server data processing system. Data processing environment 100 may also employ a service oriented architecture where interoperable software components distributed across a network may be packaged together as coherent business applications. Data processing environment 100 may also take the form of a cloud, and employ a cloud computing model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service.

Figure 2:
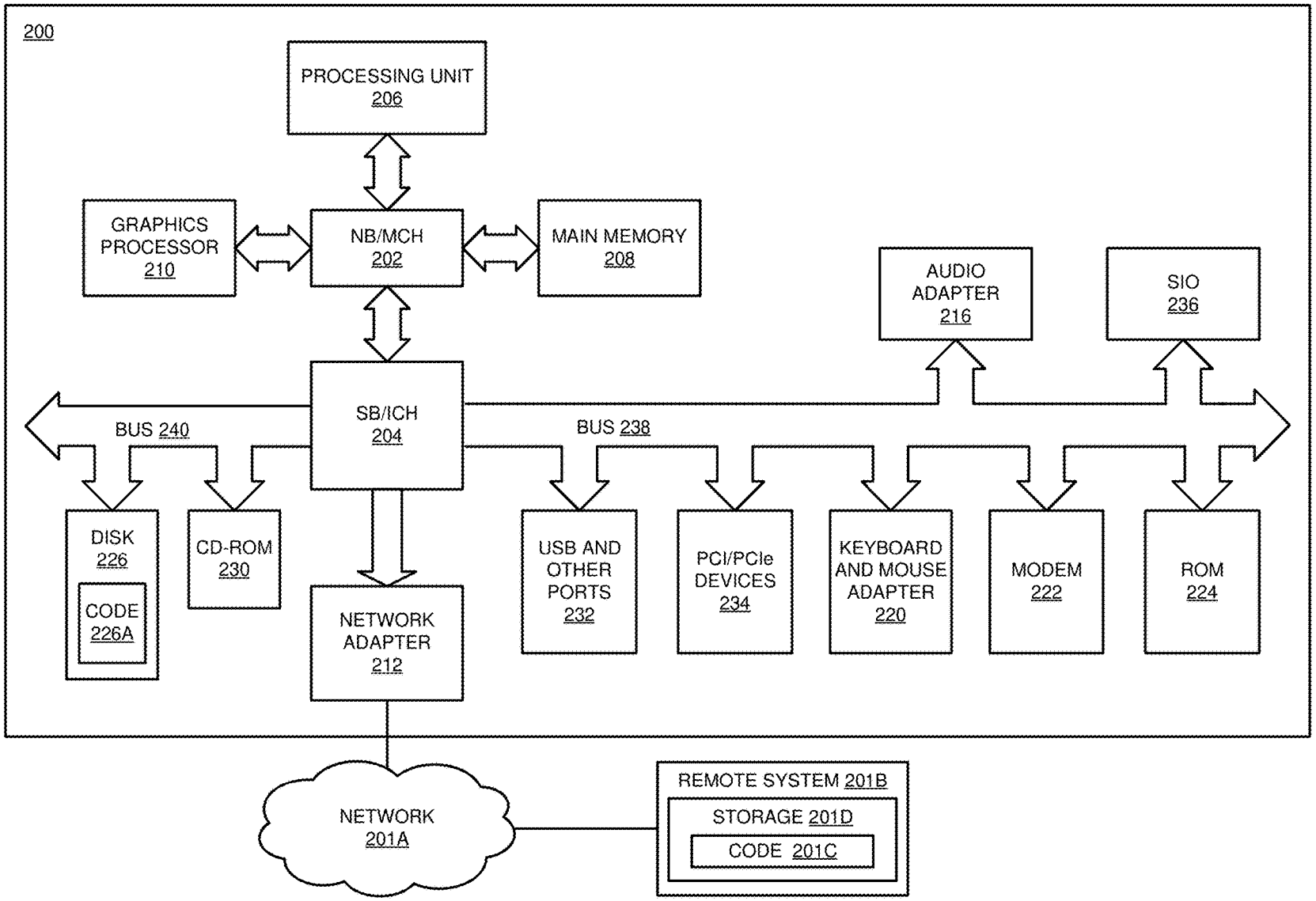
FIG. 2 depicts a block diagram of a data processing system in which illustrative embodiments may be implemented.

With reference to FIG. 2, this figure depicts a block diagram of a data processing system in which illustrative embodiments may be implemented. Data processing system 200 is an example of a computer, such as servers 104 and 106, or clients 110, 112, and 114 in FIG. 1, or another type of device in which computer usable program code or instructions implementing the processes may be located for the illustrative embodiments.

Data processing system 200 is also representative of a data processing system or a configuration therein, such as classical processing system 104 in FIG. 1 in which computer usable program code or instructions implementing the processes of the illustrative embodiments may be located. Data processing system 200 is described as a computer only as an example, without being limited thereto. Implementations in the form of other devices, such as device 132 in FIG. 1, may modify data processing system 200, such as by adding a touch interface, and even eliminate certain depicted components from data processing system 200 without departing from the general description of the operations and functions of data processing system 200 described herein.

In the depicted example, data processing system 200 employs a hub architecture including North Bridge and memory controller hub (NB/MCH) 202 and South Bridge and input/output (I/O) controller hub (SB/ICH) 204. Processing unit 206, main memory 208, and graphics processor 210 are coupled to North Bridge and memory controller hub (NB/MCH) 202. Processing unit 206 may contain one or more processors and may be implemented using one or more heterogeneous processor systems. Processing unit 206 may be a multi-core processor. Graphics processor 210 may be coupled to NB/MCH 202 through an accelerated graphics port (AGP) in certain implementations.

In the depicted example, local area network (LAN) adapter 212 is coupled to South Bridge and I/O controller hub (SB/ICH) 204. Audio adapter 216, keyboard and mouse adapter 220, modem 222, read only memory (ROM) 224, universal serial bus (USB) and other ports 232, and PCI/PCIe devices 234 are coupled to South Bridge and I/O controller hub 204 through bus 238. Hard disk drive (HDD) or solid-state drive (SSD) 226 and CD-ROM 230 are coupled to South Bridge and I/O controller hub 204 through bus 240. PCI/PCIe devices 234 may include, for example, Ethernet adapters, add-in cards, and PC cards for notebook computers. PCI uses a card bus controller, while PCIe does not. ROM 224 may be, for example, a flash binary input/output system (BIOS). Hard disk drive 226 and CD-ROM 230 may use, for example, integrated drive electronics (IDE), serial advanced technology attachment (SATA) interface, or variants such as external-SATA (eSATA) and micro-SATA (mSATA). A super I/O (SIO) device 236 may be coupled to South Bridge and I/O controller hub (SB/ICH) 204 through bus 238.

Memories, such as main memory 208, ROM 224, or flash memory (not shown), are some examples of computer usable storage devices. Hard disk drive or solid state drive 226, CD-ROM 230, and other similarly usable devices are some examples of computer usable storage devices including a computer usable storage medium.

An operating system runs on processing unit 206. The operating system coordinates and provides control of various components within data processing system 200 in FIG. 2. The operating system may be a commercially available operating system for any type of computing platform, including but not limited to server systems, personal computers, and mobile devices. An artifact oriented or other type of programming system may operate in conjunction with the operating system and provide calls to the operating system from programs or applications executing on data processing system 200.

Instructions for the operating system, the artifact-oriented programming system, and applications or programs, such as application 105 in FIG. 1, are located on storage devices, such as in the form of code 226A on hard disk drive 226, and may be loaded into at least one of one or more memories, such as main memory 208, for execution by processing unit 206. The processes of the illustrative embodiments may be performed by processing unit 206 using computer implemented instructions, which may be located in a memory, such as, for example, main memory 208, read only memory 224, or in one or more peripheral devices.

Furthermore, in one case, code 226A may be downloaded over network 201A from remote system 201B, where similar code 201C is stored on a storage device 201D. In another case, code 226A may be downloaded over network 201A to remote system 201B, where downloaded code 201C is stored on a storage device 201D.

The hardware in FIGS. 1-2 may vary depending on the implementation. Other internal hardware or peripheral devices, such as flash memory, equivalent non-volatile memory, or optical disk drives and the like, may be used in addition to or in place of the hardware depicted in FIGS. 1-2. In addition, the processes of the illustrative embodiments may be applied to a multiprocessor data processing system.

In some illustrative examples, data processing system 200 may be a personal digital assistant (PDA), which is generally configured with flash memory to provide non-volatile memory for storing operating system files and/or user-generated data. A bus system may comprise one or more buses, such as a system bus, an I/O bus, and a PCI bus. Of course, the bus system may be implemented using any type of communications fabric or architecture that provides for a transfer of data between different components or devices attached to the fabric or architecture.

A communications unit may include one or more devices used to transmit and receive data, such as a modem or a network adapter. A memory may be, for example, main memory 208 or a cache, such as the cache found in North Bridge and memory controller hub 202. A processing unit may include one or more processors or CPUs.

The depicted examples in FIGS. 1-2 and above-described examples are not meant to imply architectural limitations. For example, data processing system 200 also may be a tablet computer, laptop computer, or telephone device in addition to taking the form of a mobile or wearable device.

Where a computer or data processing system is described as a virtual machine, a virtual device, or a virtual component, the virtual machine, virtual device, or the virtual component operates in the manner of data processing system 200 using virtualized manifestation of some or all components depicted in data processing system 200. For example, in a virtual machine, virtual device, or virtual component, processing unit 206 is manifested as a virtualized instance of all or some number of hardware processing units 206 available in a host data processing system, main memory 208 is manifested as a virtualized instance of all or some portion of main memory 208 that may be available in the host data processing system, and disk 226 is manifested as a virtualized instance of all or some portion of disk 226 that may be available in the host data processing system. The host data processing system in such cases is represented by data processing system 200.

Figure 3:
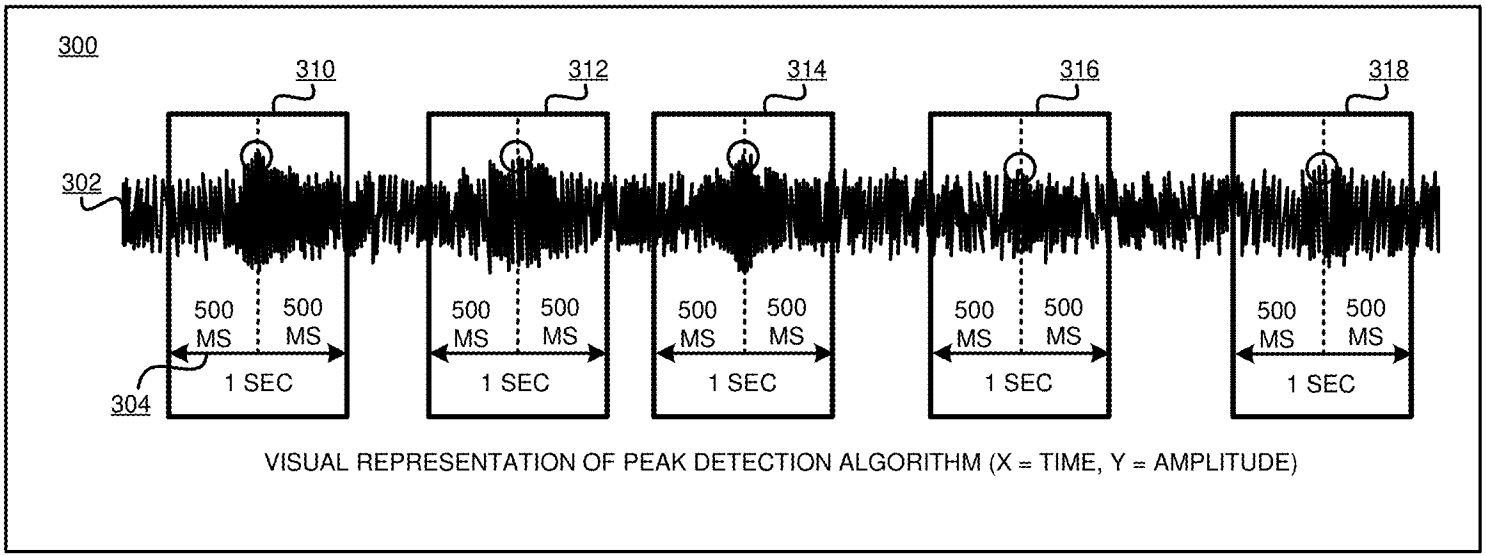
FIG. 3 depicts a functional graph of a voice signal after executing a peak detection algorithm in accordance with an illustrative embodiment.

With reference to FIG. 3, this figure depicts a functional graph 300 of a voice signal 302 after executing a peak detection algorithm in accordance with an illustrative embodiment. In graph 300, the x-axis denotes time while the y-axis denotes amplitude. The voice signal 302 represents audible sounds and is displayed as a combination of sinusoidal sound waves in the time domain with a series of snapshots (segments) 304 denoting a specific period of time of interest around several local peak amplitudes. In the present embodiment, each segment 304 has a period of 1000 milliseconds (1 second). Other time periods are possible and are not limited by this example. Graph 300 shows five different segments 304 along with peak amplitudes 310, 312, 314, 316, 318 associated with each segment 302.

In graph 300, the voice signal 302 is quantized (stratified) and the data passed through an algorithm. The algorithm detects and identifies peak amplitudes 310, 312, 314, 316, 318 in the voice signal 302. According to some embodiments, each peak amplitude 310, 312, 314, 316, 318 is the center point for a segment 304. Segments 304 are therefore centered around each peak amplitude 310, 312, 314, 316, 318, with the segments 304 containing local maxima of the voice signal 302. According to some embodiments, each peak or local maxima indicate an elevated voice power or excitement level associated with the broadcaster's narration of the sporting event.

Figure 4:
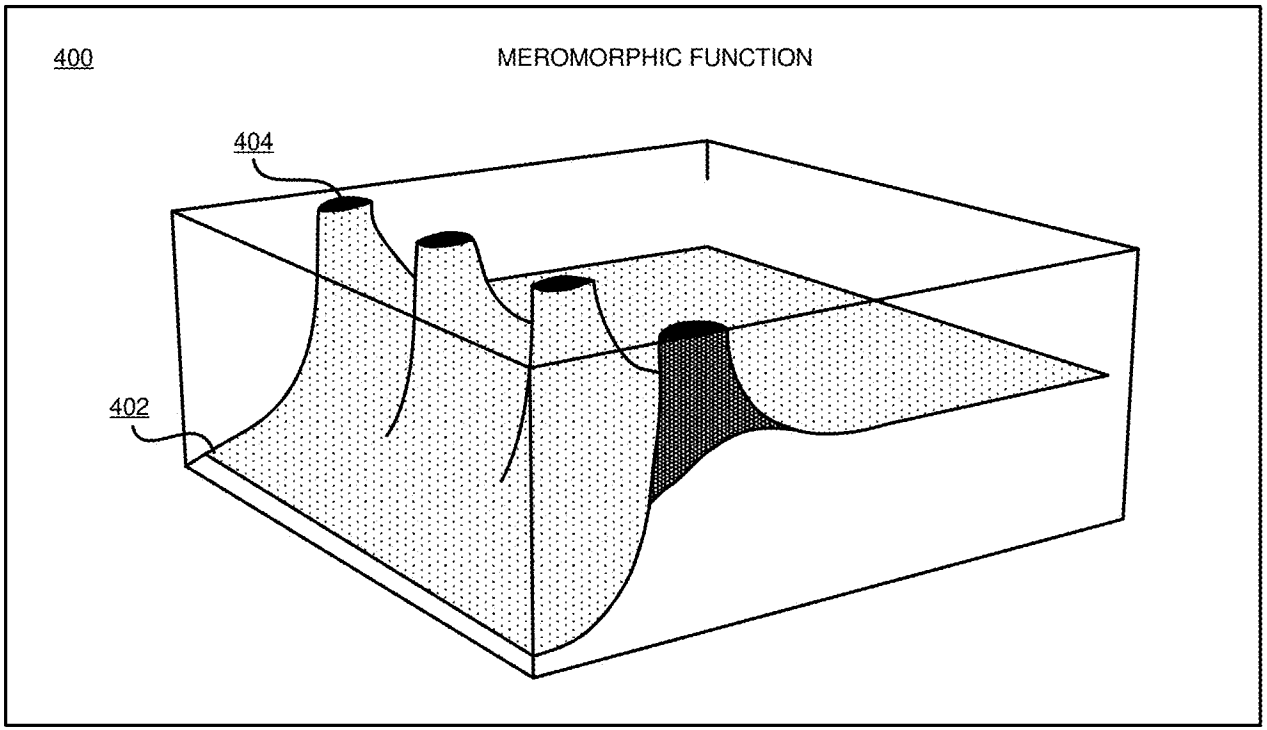
FIG. 4 depicts a functional 3-dimensional graph of a meromorphic function displaying asymptotes of a voice signal in accordance with an illustrative embodiment.

With reference to FIG. 4, this figure depicts a functional 3-dimensional display 400 of a meromorphic function graph 402 displaying multiple asymptotes 404 of a voice signal in accordance with an illustrative embodiment. In graph 400, the voice signal is presented as a complex waveform displayed over time, with a series of peak voice volume or power events appearing as asymptotes 404. An algorithm fits the meromorphic function to the peaks to form asymptotes 404.

Figure 5:
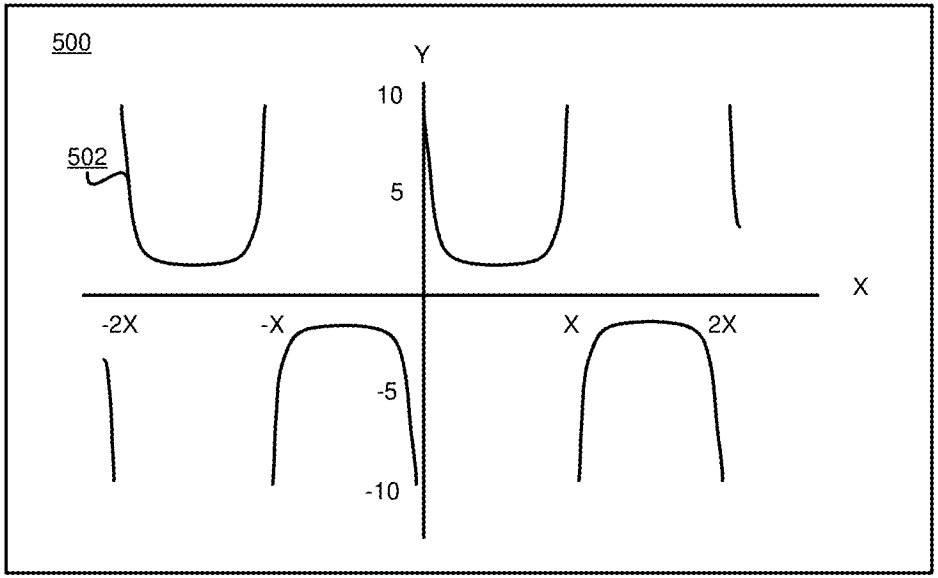
FIG. 5 depicts a functional graph of a consolidated signal after mixing two meromorphic functions together in accordance with an illustrative embodiment.

With reference to FIG. 5, this figure depicts a functional graph 500 of a consolidated signal 502 after mixing two meromorphic functions together in accordance with an illustrative embodiment. In one embodiment, a segment such as segment 304 of FIG. 3 is sampled twice; once using a forward (normal) time series and a backwards (reversed) time series to form a normal series sample and a reversed series sample, respectively. Both the normal time series and the reversed time series are formed using meromorphic functions in an algorithm. The two series are then mixed to form the consolidated signal 502.

Figure 6:
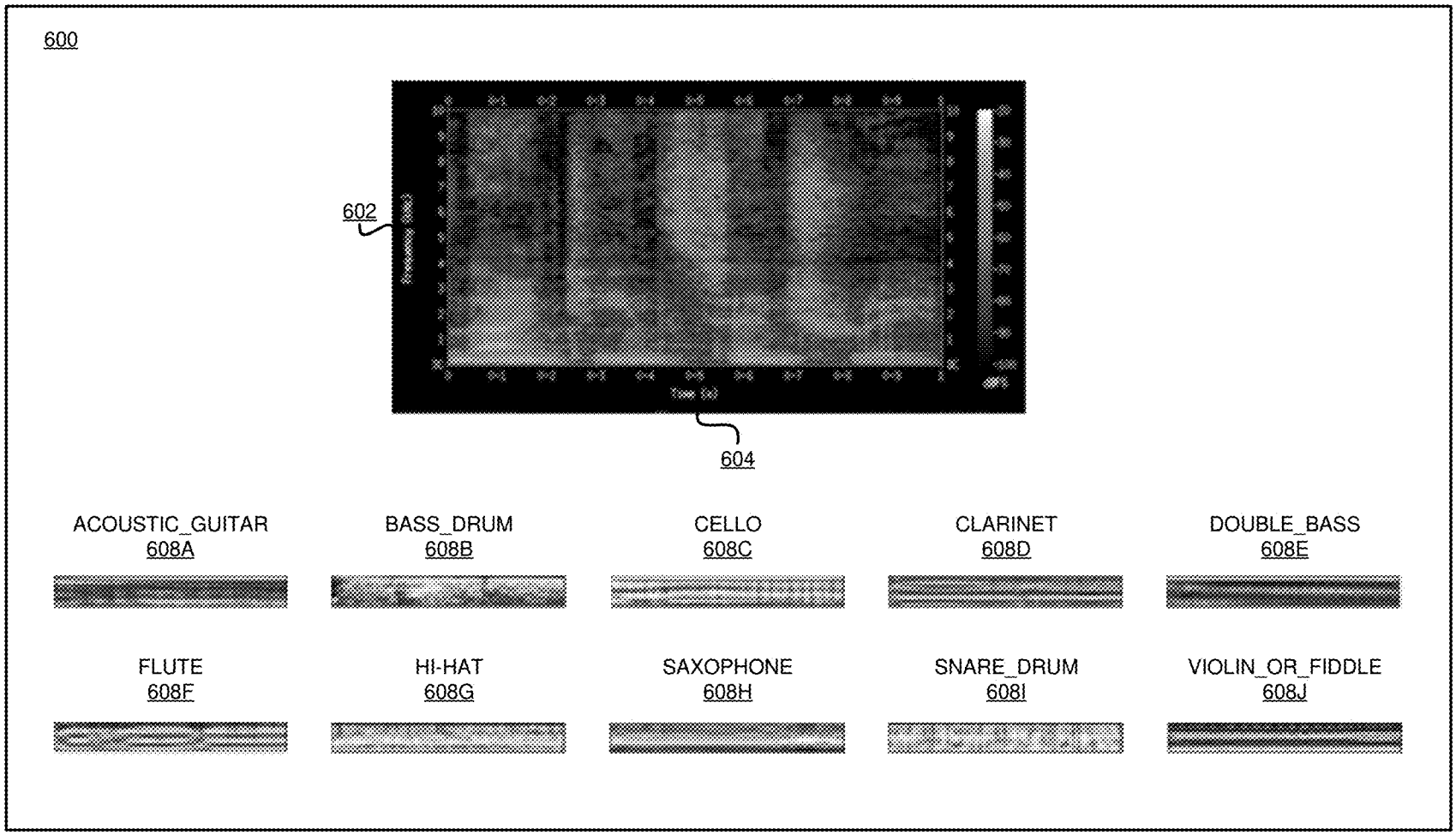
FIG. 6 depicts a functional spectrogram display showing the relative power distribution of a voice signal in accordance with an illustrative embodiment.

With reference to FIG. 6, this figure depicts a functional spectrogram display 600 showing the relative power distribution 602 of a voice signal in accordance with an illustrative embodiment. Patterns in the display 600 aid in determining the type and source of audible signals such as voice signal 302 of FIG. 3. Sound is presented as frequency vs. time and can be thought of as an image that can be applied to a CNN model for analysis. As an example, displays 608A-608J show a variety of spectrogram patterns associated with musical instruments. A spectrogram provides the high and low power distribution data of a voice signal, and also identifies moments in time when a peak or high volume event occurs. Additionally, the spectrogram display 600 aids in identifying the source of sounds found within an audible signal. According to some embodiments, a voice signal segment, such as segment 304 of FIG. 3, is 15-dimensional data which is ingested by a GMM model and an MFCC to identify a given broadcaster with their unique spectrogram data.

Figure 7:
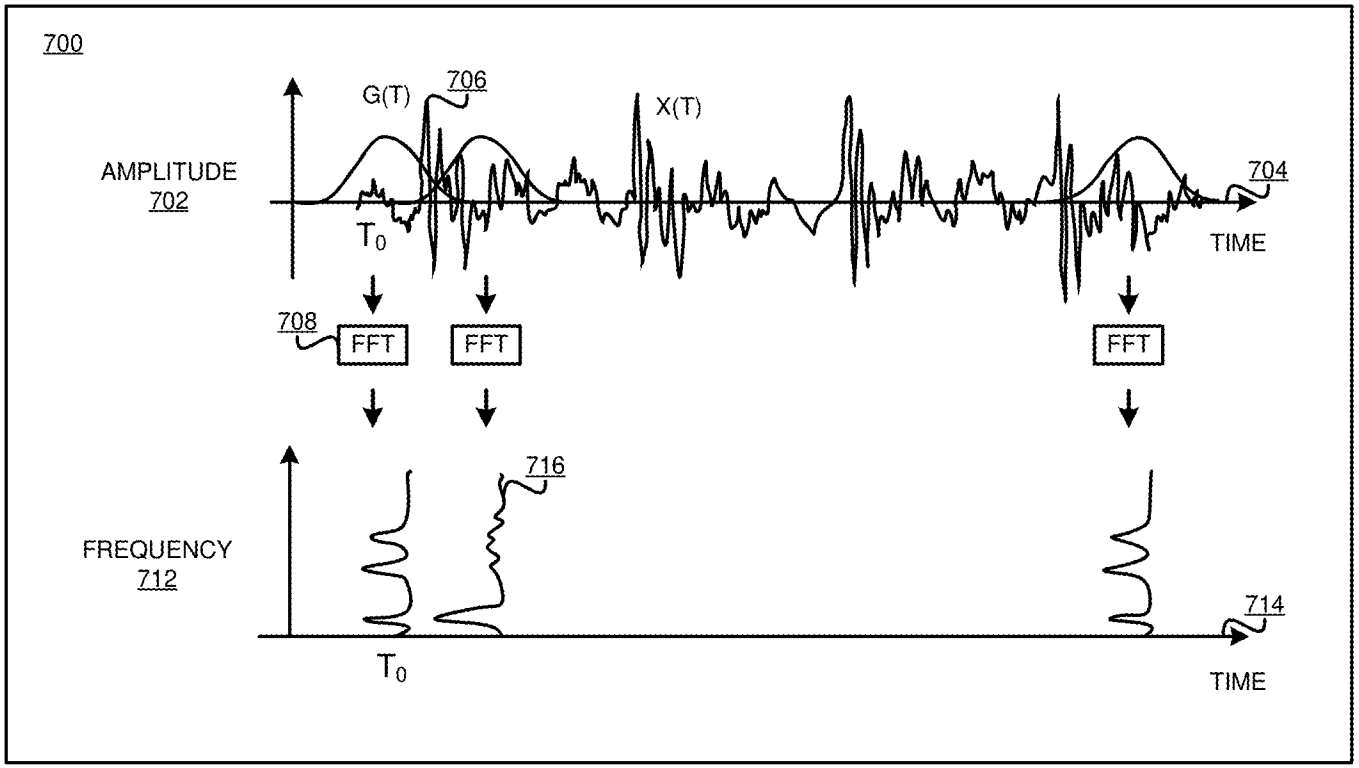
FIG. 7 depicts a transform graph of a time-based voice signal undergoing a FFT process to derive the constituent sinusoidal frequency components of the voice signal in accordance with an illustrative embodiment.

With reference to FIG. 7, this figure depicts a transform graph 700 of a time-based voice signal undergoing a FFT 708 process to derive the constituent sinusoidal frequency components 716 of the voice signal in accordance with an illustrative embodiment. Transform graph 700 includes the time-based graph showing waveform G(T) with a local peak event 706 (maxima) at time $T_0$. The time-based waveform is plotted on a graph with the x-axis 704 measured in seconds and the y-axis 702 measured in amplitude. In operation, each local peak 706 is segmented and sent through the FFT process 708, resulting in a frequency domain graph 716 of each peak amplitude. The frequency domain graph includes the x-axis 714 represents time and is measured in a time unit, e.g., seconds, and the y-axis measured in frequency 712. Using the FFT process, local peak events 706 are converted to a range of frequency signals present in the peak event 706 segment.

Figure 8:
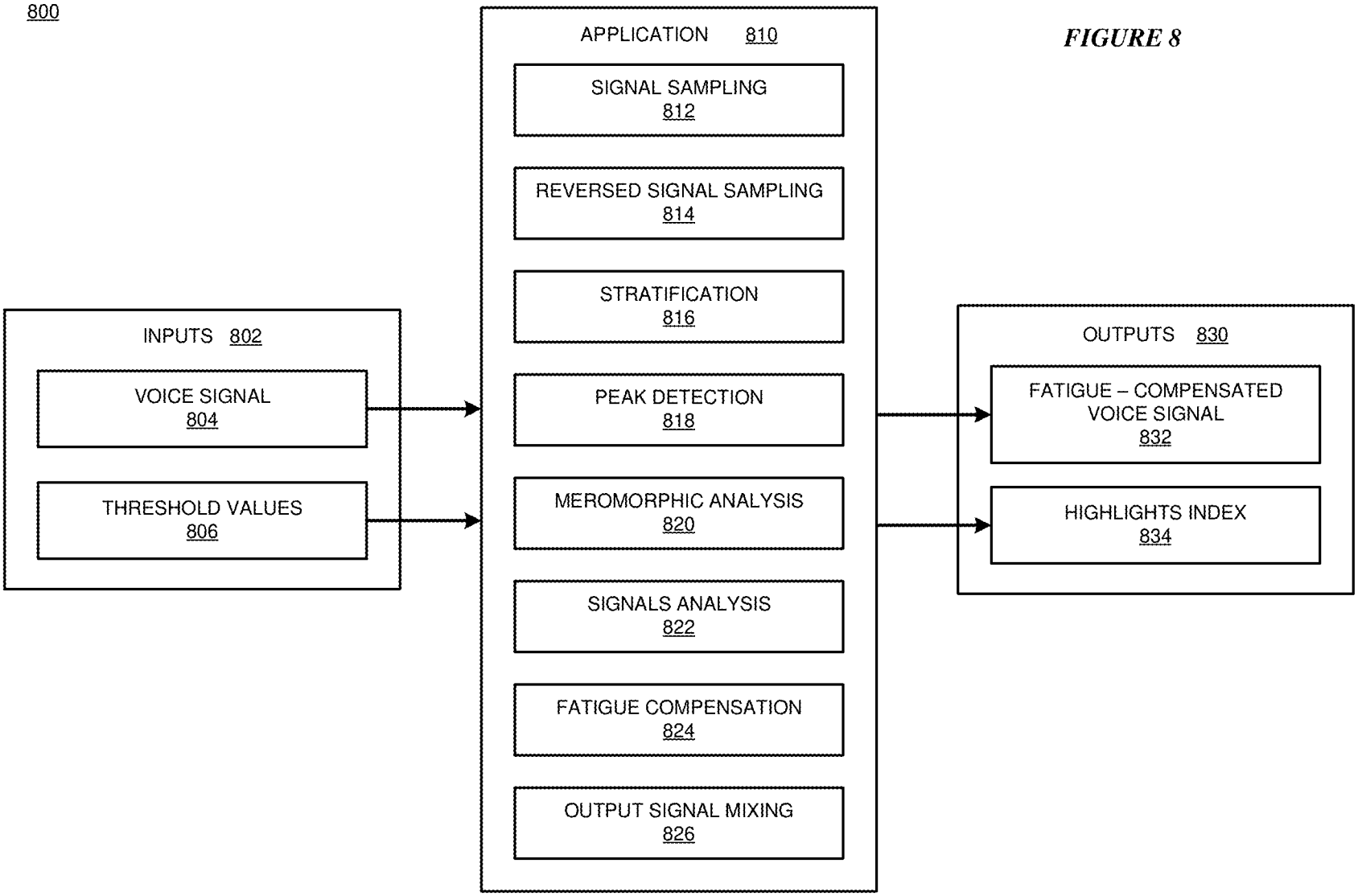
FIG. 8 depicts a block diagram of an example application for trending and micro fatigue compensation in a voice signal in accordance with an illustrative embodiment.

With reference to FIG. 8, this figure depicts a block diagram 800 of an example application 810 for trending and micro fatigue compensation in a voice signal in accordance with an illustrative embodiment. According to some embodiments, one example of application 810 is application 105 of FIG. 1. Application 810 accepts as inputs 802 a voice signal 804, such as voice signal 302 of FIG. 3, and one or more threshold values 806 such as a threshold value to identify key event moments in the voice signal as disclosed herein. The threshold values 806 can also include excitement level threshold values, volume threshold values, and the like in an effort to quantify and classify highly intense or emotional moments in a broadcast, as when a score is made.

Application 810 also generates several outputs 830 to include a fatigue-compensated voice signal 832 and a log of highlights (highlights index) 834, which contains a list of moments during the broadcast or voice signal 804 when the threshold value 806 has been exceeded. A user can access the highlights index 834 to review moments during the broadcast when high volume and excitable events took place without having to go through the entire broadcast flagging specific events. Meanwhile, the fatigue-compensated voice signal 832 is made of the original voice signal 804 that has been compensated for trending fatigue and micro fatigue as described herein.

Application 810 is made of several functional components that includes a signal sampling component 812, a reversed signal sampling component 814, a stratification component 816, a peak detection component 818, a meromorphic analysis component 820, a signals analysis component 822, a fatigue compensation component 824, and an output signal mixing component 826. Each component 812, 814, 816, 818 820, 822, 824, 826 is described in more detail as disclosed herein and in FIG. 9.

Figure 9:
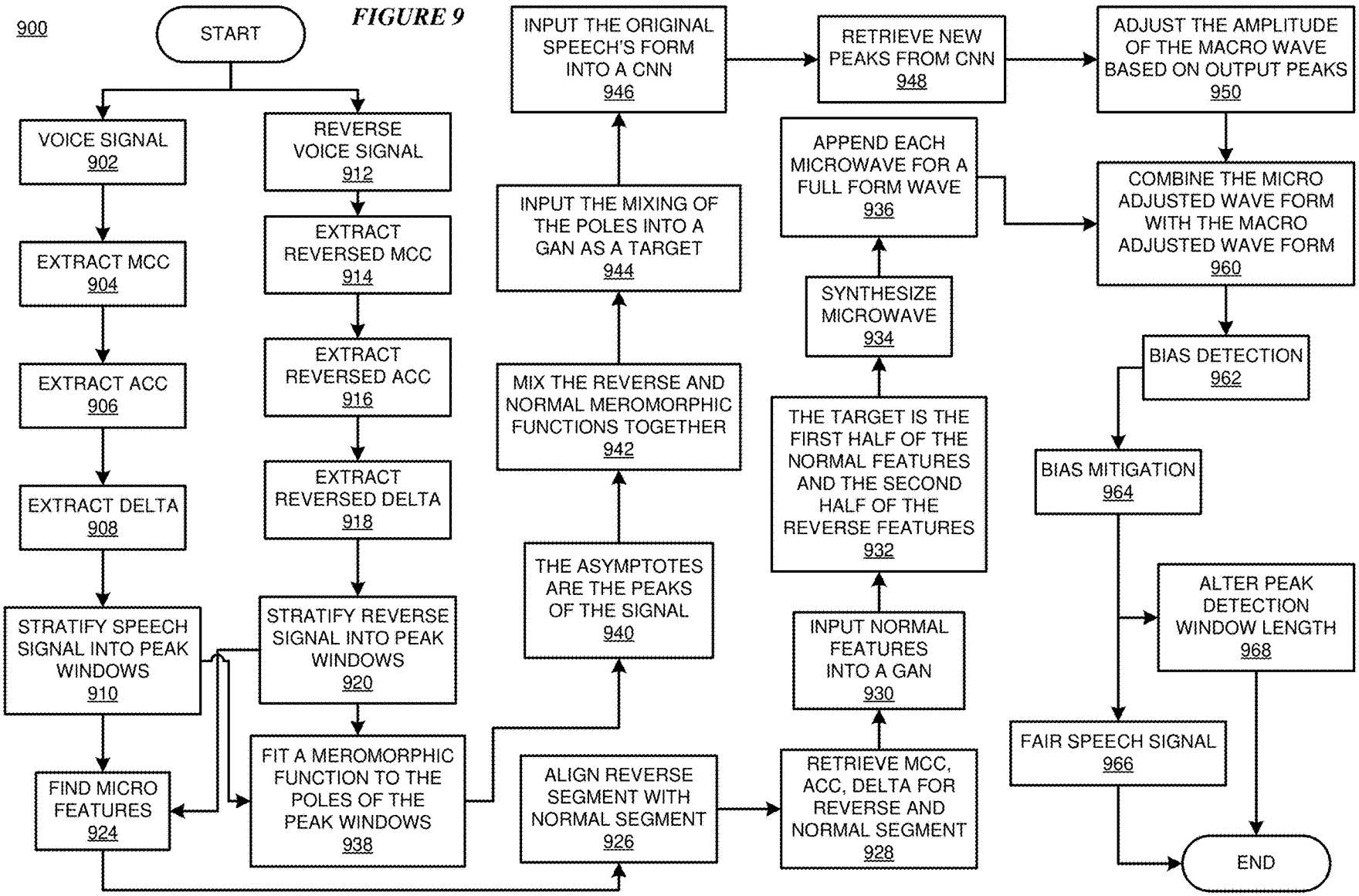
FIG. 9 depicts a flowchart of an example process of trending and context fatigue compensation in a voice signal in accordance with an illustrative embodiment.

With reference to FIG. 9, this figure depicts a flowchart of process 900 describing trending and micro fatigue compensation in a voice signal in accordance with an illustrative embodiment. For clarity, components 812, 814, 816, 818 820, 822, 824, 826 disclosed in FIG. 8 are associated with the elements of process 900 in the following manner: signal sampling component 812 is made of blocks 904, 906, and 908; reversed signal sampling component 814 is made of blocks 912, 914, 916, and 918; stratification component 816 is made of blocks 910, 920, 924, and 938; peak detection component 818 is made of blocks 946 and 948; meromorphic analysis component 820 is made of blocks 942 and 944; signals analysis component 822 is made of 926, 928, 930, 932, 934, and 936; fatigue compensation component 824 is made of blocks 950, 960, and 962; and output signal mixing component 826 is made of blocks 964, 966, and 968.

The process begins at block 902 where a voice signal, such as voice signal 302 of FIG. 3, is selected and sampled to form a normal series sample for analysis. Next, at block 904, the voice signal 302 is fed into an algorithm to extract the MCC as described herein. Next, at block 906, the voice signal 302 is fed into another algorithm to extract the ACC. Next, at block 908, the voice signal 302 is fed into yet another algorithm to extract the DELTA coefficients. Next, at block 910, the voice signal 302 is sampled and stratified to identify peak windows, or segments 302 of the voice signal for further analysis.

Simultaneously with execution of block 902, at block 912, the voice signal 302 is sampled and reversed in time to form a reversed series sample. The process continues with blocks 914, 916 and 918, where MCC, ACC, and Delta algorithms, respectively, are run on the reversed series sample. Next, at block 920, the reversed series sample is stratified to form peak windows.

Next, at block 924, the peak windows of both blocks 910 and 920 are used to find micro features in the voice signal. Following block 924, at block 926 the process continues by aligning the reversed series sample and the normal series sample. Next, at block 928, the MCC, ACC, and DELTA coefficients are retrieved for the reverse series sample and the normal series sample. The process continues at block 930 where the normal series sample is fed into a GAN. At block 932, the GAN uses a target that is comprised of the first half of the normal series sample and the last half of the reversed series sample. From the GAN, the process continues at block 934 by synthesizing a micro-wave signal. Next, at block 936, each micro-wave signal is appended to form a full form wave signal.

Meanwhile, at block 940, the output of block 938 disclosed earlier is analyzed to identify the asymptotes of the signal as being the peaks of the two signals (normal series sample and reversed series sample). Next, at block 942, mix both the meromorphic functions of the normal series sample and the reversed series sample together. Next, at block 944, the mixture of both sets of poles as a target into a GAN. Next, at block 946, the original voice signal is input into a CNN algorithm. At block 948, a new set of peaks are identified from the CNN. Next, at block 950, the process 900 continues by adjusting the amplitude of the macro wave based on the output peaks identified by the CNN.

Continuing with block 960, the micro-adjusted wave from block 936 is mixed with the macro-adjusted wave from block 936. At block 962, an accidental bias detection step is executed and at block 964, accidental bias mitigation is conducted. The process continues at block 966 where a fair speech signal is formed, while at the same time, at block 968, the peak detection window length is altered to conclude the process 900.

Thus, a computer implemented method, computer program product, and system are provided in the illustrative embodiments for compensating a voice signal for trending fatigue and micro fatigue. Where an embodiment or a portion thereof is described with respect to a type of device, the computer implemented method, computer implemented program product, or system, or a portion thereof, are adapted or configured for use with a suitable and comparable manifestation of that type of device.

Where an embodiment is described as implemented in an application, the delivery of the application in a "Software as a Service" (SaaS) model is contemplated within the scope of the illustrative embodiments. In a SaaS model, the capability of the application implementing an embodiment is provided to a user by executing the application in a cloud infrastructure. The user can access the application using a variety of client devices through a thin client interface such as a web browser (e.g., web-based e-mail), or other light-weight client-applications. The user does not manage or control the underlying cloud infrastructure including the network, servers, operating systems, or the storage of the cloud infrastructure. In some cases, the user may not even manage or control the capabilities of the SaaS application. In some other cases, the SaaS implementation of the application may permit a possible exception of limited user-specific application configuration settings.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punchcards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or artifact code written in any combination of one or more programming languages, including an artifact oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products for the compensation of voice signals for trending fatigue and micro fatigue according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reversed order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A method for voice signal fatigue compensation, comprising:

sampling, using an audio signal capturing apparatus, a segment of a voice signal in a normal time series to form a normal series sample;

generating, using a processor and a memory, from the normal series sample, a reversed series sample;

constructing, by executing using the processor and the memory a time-series mixing component, a first synthesized segment by mixing the normal series sample and the reversed series sample, the first synthesized segment including a compensation for an instance of micro fatigue in the segment of the voice signal;

forming a fatigue-compensated voice segment from the first synthesized segment; and outputting, as a fatigue-compensated voice segment, the first synthesized segment.

2. The method of claim 1, further comprising:

forming a second synthesized segment using a meromorphic normal sample formed from the normal series sample and a meromorphic reversed sample formed from the reversed series sample to compensate for an instance of trending fatigue.

3. The method of claim 1, further comprising:

respondent to sampling a segment of the voice signal, stratifying the normal series sample and the reversed series sample to identify a set of peak amplitude asymptotes of each sample; and identifying an instance of micro fatigue in the normal series sample and the reversed series sample, wherein the micro fatigue comprising a decrease in peak amplitude in the voice signal over a period.

4. The method of claim 1, further comprising:

applying a first algorithm to the meromorphic normal sample and the meromorphic reversed sample to compensate for an instance of trending fatigue.

5. The method of claim 1, wherein the first synthesized segment is comprised of a first portion of the normal series sample and a second portion of the reversed series sample.

6. The method of claim 1, further comprising:

classifying an emotion in the voice signal by detecting peak values exceeding a threshold value to identify key event moments in the voice signal.

7. The method of claim 1, further comprising:

sampling the fatigue-compensated voice segment to quantify an emotion level of the voice signal.

8. The method of claim 1, further comprising:

correcting an instance of accidental bias in the voice signal, the accidental bias comprising a variation in a set of peaks in the voice signal over a period.

9. The method of claim 1, further comprising combining a set of fatigue-compensated voice segments together to form continuous speech.

10. A computer program product for voice signal fatigue compensation, the computer program product comprising:

one or more computer readable storage media; and program instructions collectively stored on the one or more computer readable storage media, the program instructions comprising:

program instructions to sample, using an audio signal capturing apparatus, a segment of a voice signal in a normal time series to form a normal series sample;

program instructions to generate, using a processor and a memory, from the normal series sample, a reversed series sample;

program instructions to construct, by executing using the processor and the memory a time-series mixing component, a first synthesized segment by mixing the normal series sample and the reversed series sample, the first synthesized segment including a compensation for an instance of micro fatigue in the segment of the voice signal;

program instructions to form a fatigue-compensated voice segment from the first synthesized segment; and program instructions to output, as a fatigue-compensated voice segment, the first synthesized segment.

11. The computer program product of claim 10, further comprising:

respondent to sampling a segment of the voice signal, program instructions to stratifying the normal series sample and the reversed series sample to identify a set of peak amplitude asymptotes of each sample; and program instructions to identify an instance of micro fatigue in the normal series sample and the reversed series sample, the micro fatigue comprising a decrease in peak amplitude in the voice signal over a period.

12. The computer program product of claim 11, further comprising:

program instructions to apply a first algorithm to the meromorphic normal sample and the meromorphic reversed sample to compensate for an instance of trending fatigue.

13. The computer program product of claim 10, further comprising:

program instructions to form a second synthesized segment using a meromorphic normal sample formed from the normal series sample and a meromorphic reversed sample formed from the reversed series sample to compensate for an instance of trending fatigue.

14. The computer program product of claim 10, further comprising:

program instructions to correct an instance of accidental bias in the voice signal, the accidental bias comprising a variation in a set of peaks in the voice signal over a period.

15. The computer program product of claim 10, wherein computer usable code is stored in a computer readable storage device in a data processing system, and wherein the computer usable code is transferred over a network from a remote data processing system.

16. The computer program product of claim 10, wherein computer usable code is stored in a computer readable storage device in a server data processing system, and wherein the computer usable code is downloaded over a network to a remote data processing system for use in a computer readable storage device associated with the remote data processing system.

17. A computer system, comprising:

a processor;

a computer-readable memory;

a computer-readable storage device; and program instructions stored on the storage device for execution by the processor via the memory, the stored program instructions comprising:

program instructions to sample, using an audio signal capturing apparatus, a segment of a voice signal in a normal time series to form a normal series sample;

program instructions to generate, using a processor and a memory, from the normal series sample, a reversed series sample;

program instructions to construct, by executing using the processor and the memory a time-series mixing component, a first synthesized segment by mixing the normal series sample and the reversed series sample, the first synthesized segment including a compensation for an instance of micro fatigue in the segment of the voice signal;

program instructions to form a fatigue-compensated voice segment from the first synthesized segment; and program instructions to output, as a fatigue-compensated voice segment, the first synthesized segment.

18. The computer system of claim 17, further comprising:

respondent to sampling a segment of the voice signal, program instructions to stratifying the normal series sample and the reversed series sample to identify a set of peak amplitude asymptotes of each sample; and program instructions to identify an instance of micro fatigue in the normal series sample and the reversed series sample, the micro fatigue comprising a decrease in peak amplitude in the voice signal over a period.

19. The computer system of claim 17, further comprising:

program instructions to forming a second synthesized segment using a meromorphic normal sample formed from the normal series sample and a meromorphic reversed sample formed from the reversed series sample to compensate for an instance of trending fatigue.

20. The computer system of claim 17, further comprising: program instructions to correct an instance of accidental bias in the voice signal, the accidental bias comprising a variation in a set of peaks in the voice signal over a period.

* * * * *